US005924462A

United States Patent [19]

McKaughan

[11] Patent Number: 5,924,462

[45] Date of Patent: Jul. 20, 1999

[54] BEVERAGE FILLING MACHINE

[75] Inventor: Ted McKaughan, Forest Hill, Md.

[73] Assignee: Crown Simplimatic, Baltimore, Md.

[21] Appl. No.: 08/922,657

[22] Filed: Sep. 3, 1997

[51] Int. Cl.[6] ..... B65B 3/06

[52] U.S. Cl. ..... 141/145; 141/39; 141/147

[58] Field of Search ..... 141/144, 145, 141/146, 147, 39, 40, 44, 45, 47, 48, 49, 50

[56] References Cited

U.S. PATENT DOCUMENTS

| | | | |
|---|---|---|---|
| 2,676,742 | 4/1954 | Day et al. | 141/6 |
| 2,695,743 | 11/1954 | Wetherby-Williams | 141/9 |
| 2,728,511 | 12/1955 | Breeback . | |
| 3,825,043 | 7/1974 | Fechheimer | 141/147 |
| 3,946,770 | 3/1976 | Trinne et al. | 141/5 |
| 4,103,721 | 8/1978 | Noguchi | 141/6 |
| 4,442,873 | 4/1984 | Yun . | |
| 4,688,608 | 8/1987 | Puskarz et al. | 141/39 |
| 5,054,527 | 10/1991 | Rozier | 141/39 |
| 5,060,702 | 10/1991 | LaWarre, Sr. et al. | 141/39 |
| 5,150,740 | 9/1992 | Yun . | |
| 5,295,520 | 3/1994 | Acker . | |

*Primary Examiner*—Henry J. Recla
*Assistant Examiner*—Kerry S Culpepper
*Attorney, Agent, or Firm*—Howard & Howard

[57] ABSTRACT

A filling apparatus (10) for filling beverage containers (C) with carbonated liquid beverage (B) includes a rotating filling table (16) in which is supported a central tank (26). Beverage containers (C) are sequentially brought into registry with the filling table (16) where they undergo successive phases of vacuum, counter pressure, fill/vent, and snifting before they are released to a separate capping operation. A liquid supply (14) feeds liquid beverage (B) to the bottom of the central tank (26) and a CO2 supply (32) feeds pressurized CO2 into the top of the central tank (26). A plurality of valve housings (44) are spaced in generally equal radial and equal circumferential increments about the periphery of the filling table (16) and are associated with a beverage container (C) being filled. Liquid (36), gas (38) and vent (40) conduits extend between the central tank (26) and each valve housing (44). Each valve housing (44) includes a liquid chamber (54) having an outlet (52) for discharging liquid into the beverage container (C), and a vent chamber (60) isolated from the liquid chamber (54). A reciprocating valve (100) is linearly slidably disposed in each valve housing (44) for selective movement between a closed position sealing the outlet (52) and a fill position for passing liquid through the outlet (52) to the beverage container (C). The valves (100) each include a liquid section immersed in the liquid chamber (54), and a vent section disposed in the vent chamber (60). The durable reciprocating valves (100) can be retrofit on central tank filling units still in service, as well as used in new manufacture central tank filling machines.

11 Claims, 4 Drawing Sheets

BEVERAGE FILLING MACHINE

BACKGROUND OF THE INVENTION

1. Field of the Invention

The subject invention relates to a filling apparatus for filling beverage containers with carbonated liquid, and more specifically to an improved filler valve arrangement for such an apparatus having a centrally located carbonated beverage tank.

2. Description of Related Art

Filling apparatus for filling beverage containers with carbonated beverage, e.g., beer and carbonated soft drinks, are large high-speed machines which can continuously fill 800 or more beverage containers per hour. Such filling apparatus have in the past been constructed according to either of two tank types: central tank and annular (or torroidal) tank. Generally, the filler valve components of central tank type machines are not interchangeable with those of annular tank type machines, and vice versa. Traditionally, the central tank type filling apparatus have been used for beer, whereas the annular tank type machines have been used for soft drinks. Although more recently, the industry has seen increasing acceptance of the annular tank type units for filling both soft drink and beer containers.

In a central tank type filling apparatus, an array of remote valve housings are fed with beer and $CO_2$ via conduits from the pressurized central tank. The filler valves in the valve housings each comprise stacked disks or plates which are pressed tightly together and rotate between various positions to accommodate the vacuum/counter pressure/fill/snift operations. Examples of central tank type filling apparatus with the traditional disk valves are shown in U.S. Pat. No. 2,728,511 to Breeback, issued Dec. 27, 1955 and assigned to the assignee of the subject invention, and U.S. Pat. No. 5,295,520 to Acker, issued Mar. 22, 1994.

The inner valve bodies of the central tank-type disk valve have large surface areas which are pressed together in tight frictional contact to prevent leakage between the various openings. However, these compressed plates must rotate against each other. Rapid wear between the compressed plates of the disk valve is accentuated by the hard granular residue left by evaporated beer. Hence, a major disadvantage of the central tank type filling machines lay in its disk valves which characteristically exhibit poor pressure holding capabilities and require frequent maintenance due to rapid wear between the rotating inner valve body surfaces.

Annular tank filling machines, on the other hand, employ reciprocating filler valves which do not rely on large rotating surfaces to maintain pressure seals. Such reciprocating filler valves are located within the annular tank, having a lower section immersed in the liquid and a top section communicating directly with the pressurized $CO_2$ for the counter-pressure and venting phases of the filling operation. Therefore, reciprocating filler valves receive liquid beverage and $CO_2$ directly from, and vent directly back into, the annular tank. Reciprocating filler valves generally exhibit increased pressure holding capabilities and lower (more favorable) maintenance requirements. Examples of prior art reciprocating filler valves for annular tank-type machines may be found in U.S. Pat. No. 4,442,873 issued Apr. 17, 1984 and U.S. Pat. No. 5,150,740 issued Sep. 29, 1992, both in the name of Yun and both assigned to the assignee of the subject invention.

There are a great many central tank filling apparatus still in service. However, there is no know way to integrate the more reliable reciprocating filler valves, which require immersion in the liquid beverage, with the central tank type units which feed the remote filler valves via conduits.

SUMMARY OF THE INVENTION

The subject invention comprises a central tank filling apparatus which employs reciprocating filler valves. The apparatus includes a base defining a generally vertical axis of rotation. A central tank is rotatably supported on the base about the axis and has a pressure containing interior region. A liquid supply communicates with the central tank for feeding liquid to the interior region. A plurality of receiving areas are spaced in generally equal radial and equal circumferential increments about the axis and are fixedly connected to the central tank for rotation therewith upon the base. A liquid conduit extends between the interior region of the central tank and each receiving area. A valve housing is supported on each receiving area and communicates with a corresponding one of the liquid conduits. Each valve housing includes an outlet for discharging liquid into a beverage container.

The improvement of the subject invention comprises a reciprocating filler valve which is linearly slidably disposed in each valve housing for selective movement between a closed position sealing the outlet and a fill position for passing liquid through the outlet to a beverage container. By using a reciprocating filler valve, as has been exclusively associated in the prior art with annular tanks, the subject invention overcomes the disadvantages and limitation of the prior art disk-type filler valves. The more popular and current manufacture reciprocating filler valves can now be retrofit on central tank filling units still in service. In this manner, both new manufacture and existing central tank filling machines can be outfitted/retrofitted with the more durable and pressure hardy reciprocating filler valves.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
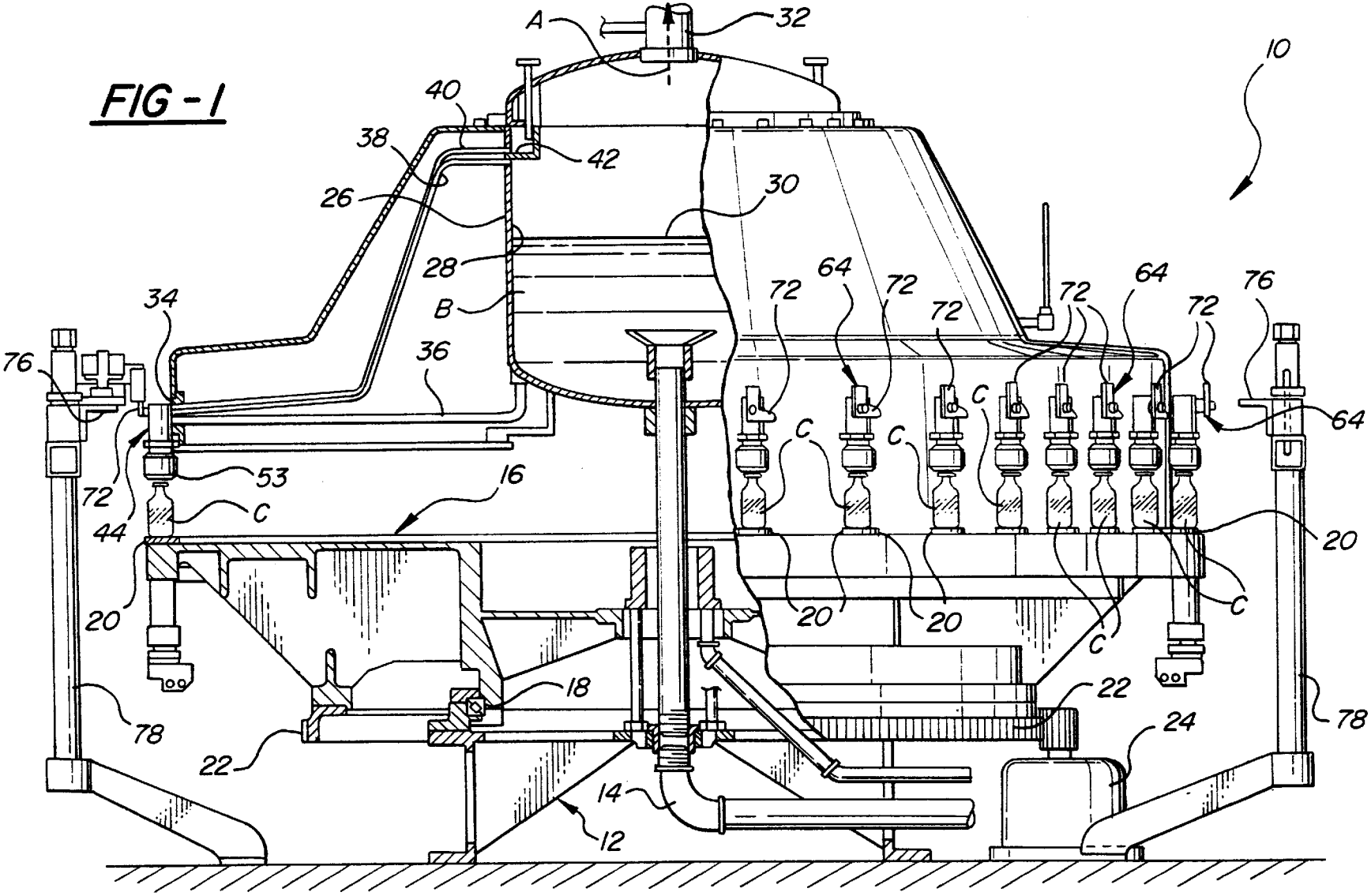
FIG. 1 is a partial cross-sectional view of a filling apparatus for filling beverage containers with carbonated liquid according to the subject invention.

Referring to the Figures, wherein like numerals indicate like or corresponding parts throughout the several views, a filling apparatus for filling beverage containers with carbonated liquid is generally shown at 10 in FIG. 1. The filling apparatus 10 comprises a base, generally indicated at 12, which is fixed to a floor support and forms the non-moving portion of the filling apparatus 10. The base 12 includes a liquid supply conduit 14 which is centrally located coincident with a generally vertical axis of rotation A. The liquid supply conduit 14 is non-rotating and receives a pressurized flow of liquid beverage B from a pump and supply reservoir (not shown).

A filling table, generally indicated at 16 in FIG. 1, is rotatably supported upon the base 12 via bearing 18. The filling table 16 includes a plurality of container platforms 20 spaced incrementally, i.e., uniformly, about the circumference of the table 16 for each supporting a beverage container C during the filling process. As is well known in the art, the platforms 20 are vertically indexable to bring containers C into and out of registry with an overhead filler valve assembly, as described in greater detail below. A large externally-toothed ring gear 22 is engaged by the pinion on a drive motor 24 to forcibly rotate the filling table 16 about the vertical axis A. In this manner, beverage containers C are placed on successive platforms 20 where they rotate with the filling table 16 throughout a portion of one complete revolution during the sequential vacuum/counter-pressure/fill/snift operations. The beverage containers C are then removed from the platforms and delivered promptly to a capping or other such closure operation. Although the drawing figures illustrate the beverage container C as a typical necked glass bottle, those skilled in the art will readily appreciate that the subject invention can be practiced with plastic bottles and can-type beverage containers.

A central tank 26 is fixed to the filling table 16 for rotation therewith over the base 12. The central tank 26 is of the type having a pressure containing interior region 28 which is intersected by the central axis A. The liquid supply conduit 14 delivers liquid beverage B under pressure into the bottom of the interior region 28. The liquid level 30 of the liquid beverage B is maintained at a preferred elevation in the interior region 28. Pressurized $CO_2$ is delivered via a gas supply 32 into the top of the interior region 28 to occupy the space above the liquid level 30.

The filling table 16 further includes a plurality of receiving areas 34 aligned substantially directly above each platform 20, i.e., in radial and circumferential increments substantially equivalent to the platforms 20. In this manner, the receiving areas 34 rotate about the vertical axis A together with the platforms 20 and the central tank 26. A separate liquid conduit 36 extends from the bottom of the interior region 28 (i.e., below the liquid level 30) to each receiving area 34. Similarly, a gas conduit 38 extends from the top of the interior region 28 (i.e., above the liquid level 30) to each receiving area 34 for conducting pressurized $CO_2$ thereto. Also, a vent conduit 40 extends between a segregated vent receptacle 42 in the interior region 28 of the central tank 26 to each receiving area 34.

Figure 2:
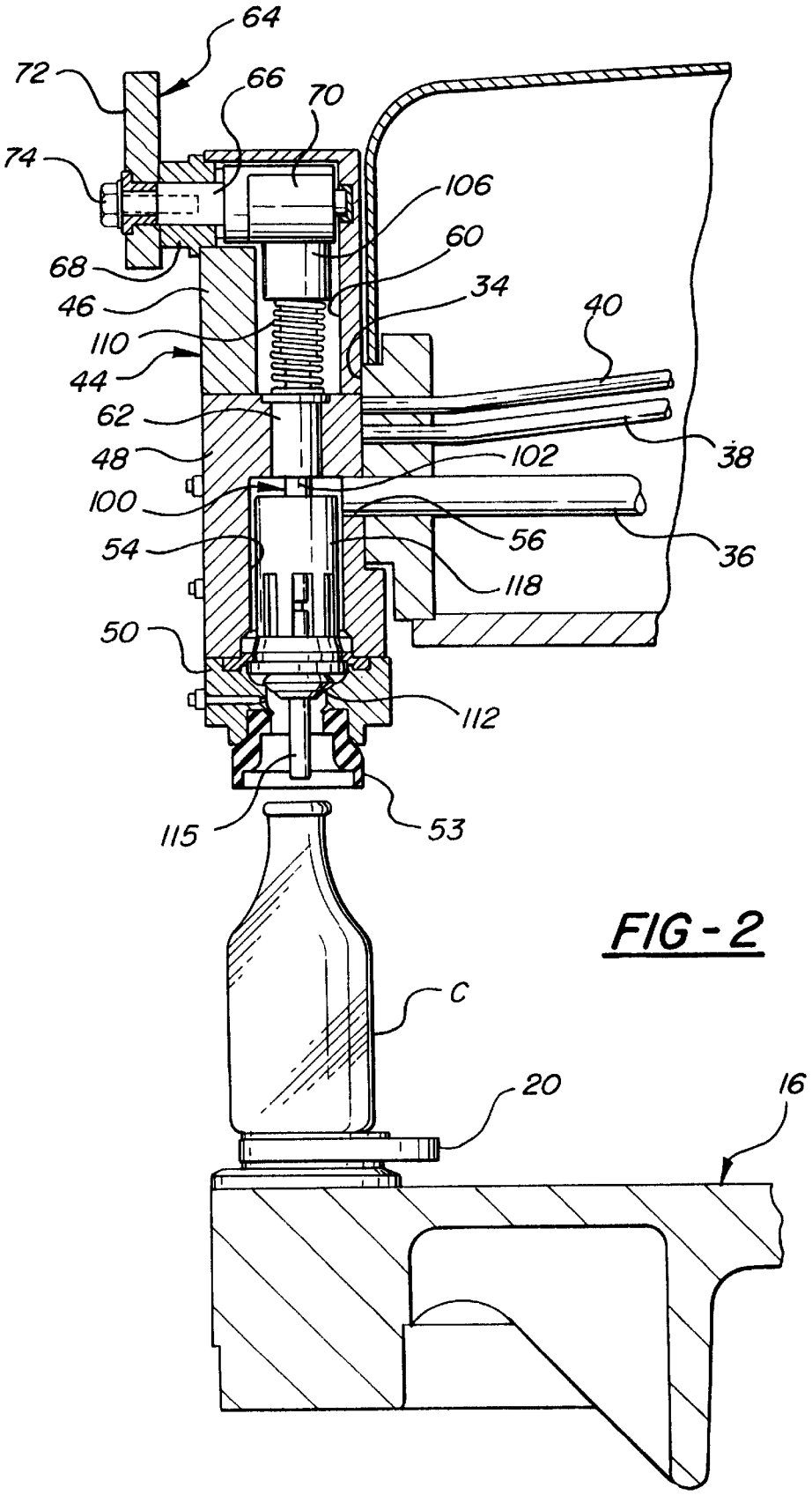
FIG. 2 is a fragmentary cross-sectional view showing the improved filler valve and valve housing assembly attached to the receiving area of the filling apparatus and a beverage container positioned directly there below.
Figure 3:
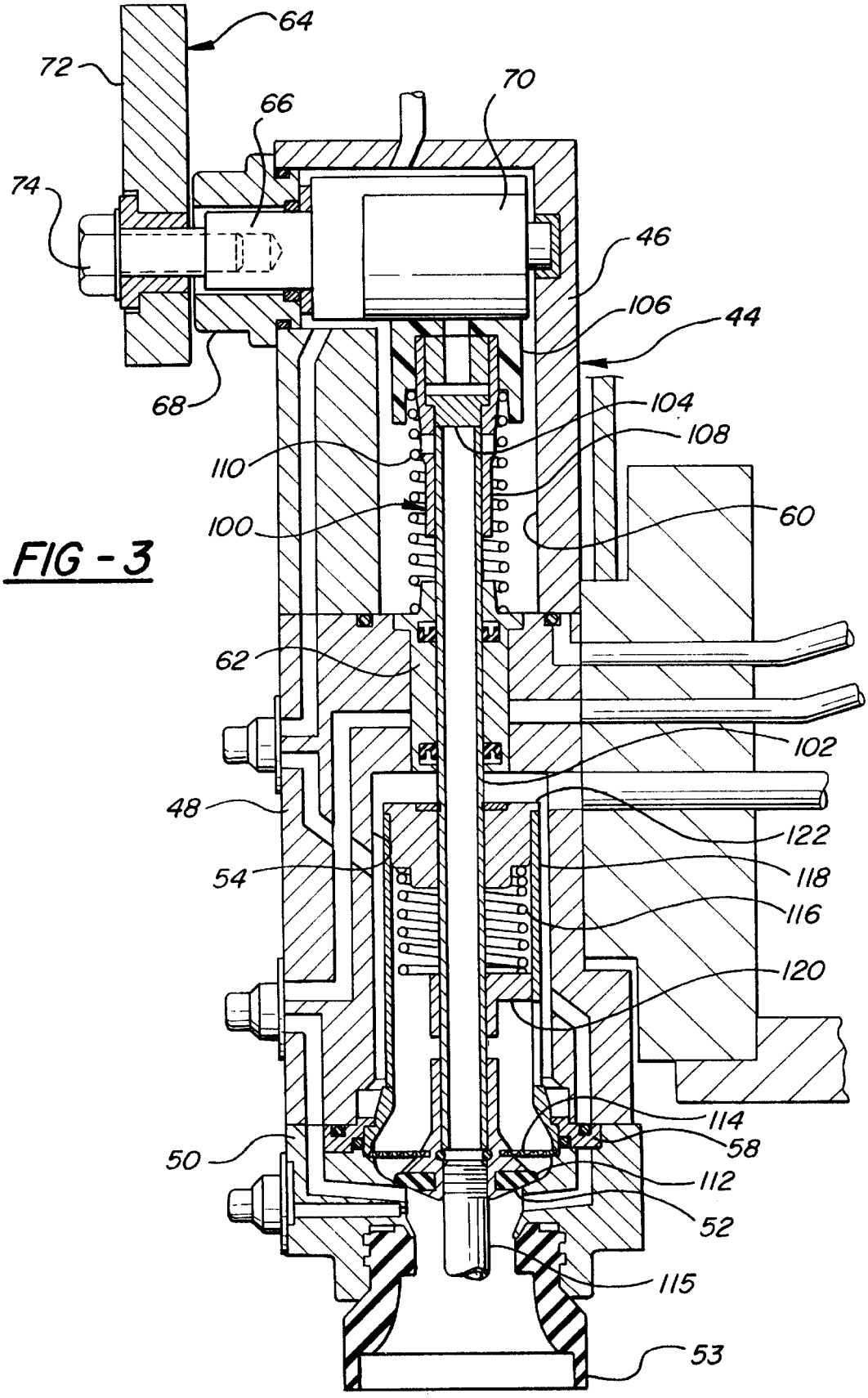
FIG. 3 is a cross-sectional view of the filler valve and valve housing, with the filler valve shown in its closed position for respective vacuum, counter-pressure, filling and snifting operations.
Figure 4:
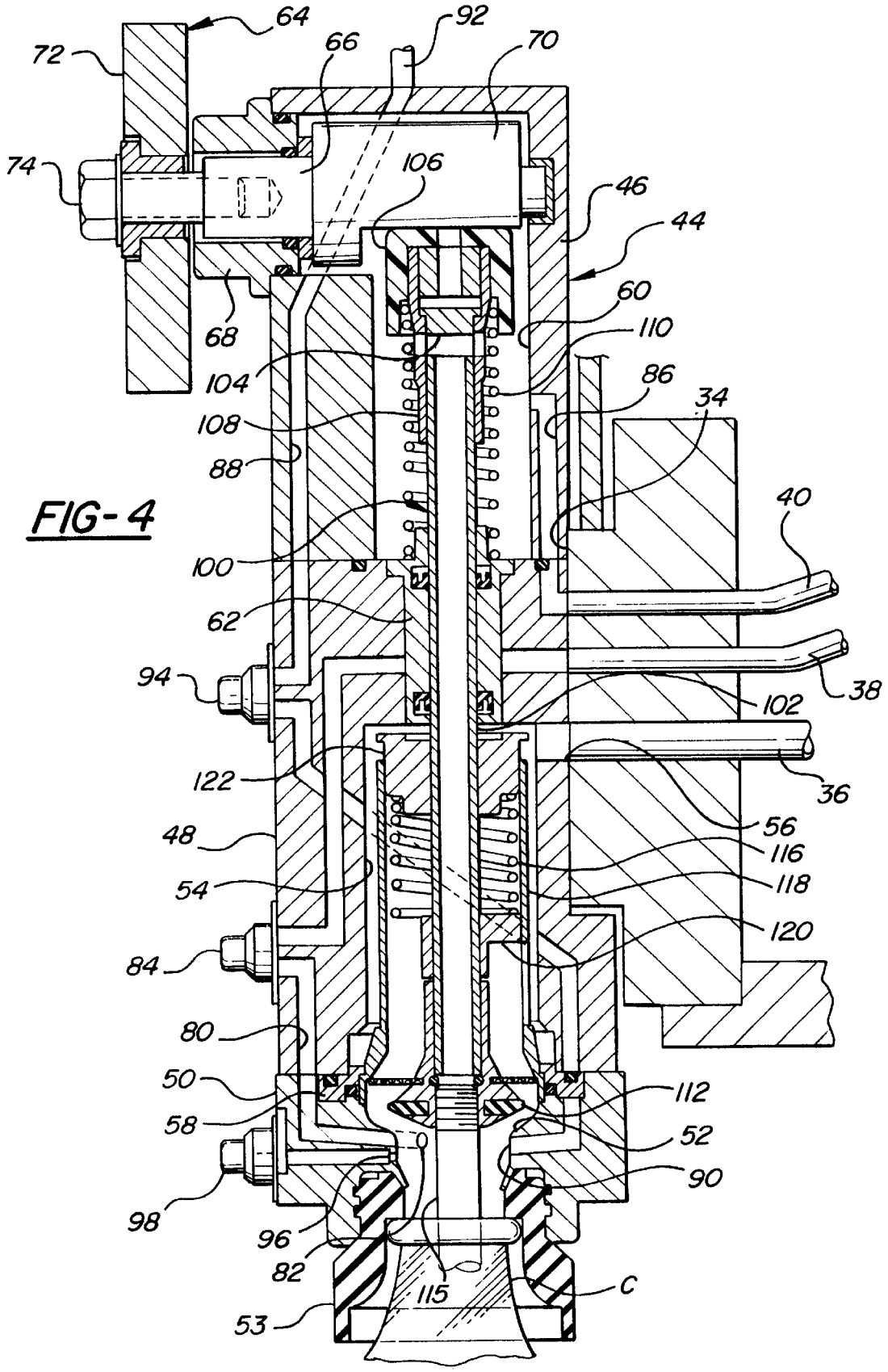
FIG. 4 is cross-sectional view as in FIG. 3 showing the filler valve in its open position for simultaneous beverage filling and venting operations.

A valve housing, generally indicated at 44 in FIGS. 1–4, is attached to each receiving area 34 and preferably includes an upper body section 46, a middle body section 48, and a lower body section 50. The valve housing 44 communicates with each corresponding liquid conduit 36, gas conduit 38 and vent conduit 40 through respective openings in the middle body section 48, as shown in FIG. 4. The valve housing 44 further includes an outlet 52 in the lower body section 50 for discharging liquid beverage B and $CO_2$ into a beverage container C. A centering bell 53 extends from the lower body section 50, in alignment with the outlet 52, for receiving the mouth of a beverage container C.

The valve housing 44 includes a liquid chamber 54 formed substantially within the middle body section 48 and partially with the lower body section 50. The liquid chamber 54 communicates directly with the outlet 52, and is fed liquid beverage B from the liquid conduit 36 via a short liquid passage 56. A seal 58 prevents leakage of the liquid beverage B, which is at an elevated pressure relative to atmospheric, into the interface between the middle 48 and lower 50 body sections.

The valve housing 44 also includes a vent chamber 60 formed substantially within the upper body section 46 but bounded along its bottom by the middle body section 48. A stem bushing 62 is disposed in the middle body section 48, between the vent chamber 60 and the liquid chamber 54, for preventing liquid beverage B migration into the vent chamber 60. In other words, the vent chamber 60 is isolated from the liquid chamber 54 in the valve housing 44 because the liquid level 30 in the interior region 28 of the central tank 26 may be maintained above vent chamber 60 elevation and would otherwise cause flooding of the vent chamber 60.

A valve actuator, generally indicated at 64 in FIGS. 3 and 4, extends through an aperture in the upper body section 46 and into the vent chamber 60. The valve actuator 64 includes a shaft 66 pivotally journaled in a bearing 68, which is set in the upper body section 46. The shaft 66 is thus supported for rotation about a generally horizontal axis, and includes an internal cam 70 on its interior end and a rotating external cam 72 on its exterior end. In the preferred embodiment, the internal cam 70 is generally cylindrical with a flat surface therein formed parallel to its horizontal axis of rotation. A bolt 74 or other such fastener may be used to secure the external cam 72 onto the exterior end of the shaft 66.

Referring again to FIG. 1, a generally annular cam rail 76 is fixedly supported on stanchions 78 about the exterior of the rotating filling table 16. As the filling table 16 rotates, the external cam 72 of each valve housing 44 engages a specially profiled cam (not shown) supported on the cam rail 76 to forcibly pivot the shaft 66 in either direction, thereby causing the internal cam 70 to rotate back and forth at predetermined intervals to open for filling/venting and close before snifting operations.

Numerous passages are formed in the valve housing 44 to carry out the movement of the various gases during the vacuum, counter pressure, and snift operations. More specifically, and referring again to FIGS. 3 and 4, the valve housing 44 includes a pressurized gas ($CO_2$) passage 80 routing through the middle 48 and lower 50 body sections. The gas passage 80 connects to the gas conduit 38 and has a discharge 82 in the lower body section 50 just downstream of the outlet 52. A normally closed flow control valve 84 is located in the middle body section 48, upstream of the discharge 82. The flow control valve 84 has a protruding push button which is depressed by a cam (not shown) supported on the cam rail 76. In this manner, the flow control valve 84 is actuated along a predetermined arc of movement of the filling table 16 to cause pressurized $CO_2$ to flow from the gas conduit 38 and out the discharge 82 during the counter pressure phase.

The valve housing 44 also includes a vent passage 86 formed in both the middle 48 and upper 46 body sections. The vent passage 86 routes vented $CO_2$, still under pressure, from the vent chamber 60 to the vent conduit 40. Furthermore, the valve housing 44 includes a vacuum passage 88 extending through all of the upper 46, middle 48 and lower 50 body sections. The vacuum passage 88 has an inlet 90 in the lower body section 50 just downstream of the sealing surface in relative proximity to the discharge 82 for the gas passage 80. A vacuum conduit 92 extending from a vacuum generator, not shown, connects to the vacuum passage 88 for removing gases from a beverage container C during an initial vacuum operation, as described in detail below. A normally closed vacuum control valve 94 is operatively disposed on the middle body section 48, and has a protruding push button which is depressed by a cam (not shown) supported on the cam rail 76. In this manner, the vacuum control valve 94 is actuated along a predetermined arc of movement of the filling table 16 to cause gases present initially in an empty beverage container C to be sucked out through the inlet 90 during the vacuum phase.

Additionally, the valve housing 44 includes a snift aperture 96 downstream of the outlet 52, also in proximity with the discharge 82 and inlet 90. A normally closed snift control valve 98 is operatively associated with the snift aperture 96 for controlling depressurization of a filled beverage container C. The snift control valve 98 is attached to the lower body section 50 and also has a protruding push button which is depressed by a cam (not shown) supported on the cam rail 76 after completing the fill cycle. When the snift control valve 98 is depressed, the pressurized gas in the neck of the beverage container C is discharged, returning the interior of the beverage container C to atmospheric pressure prior to separation from the centering bell 53.

A vent stem and valve assembly, generally indicated at 100 in FIGS. 2–4, is linearly slidably disposed in the valve housing 44 for selective reciprocating movement between a closed position (FIG. 3) sealing the outlet 52 and a fill position (FIG. 4) for passing liquid beverage B through the outlet 52 to a beverage container C. Preferably, only one valve assembly 100 is located in each valve housing 44 and serves only one beverage container C at a time. The valve assembly 100 includes an elongated stem 102 oriented vertically and slidably disposed within both the vent 60 and liquid 54 chambers by the stem bushing 62. The stem 102 is hollow and forms a bypass through the liquid chamber 54 for venting pressurized gas from the beverage container C to the vent chamber 60 during the filling operation.

The upper end of the stem 102 comprises a vent section which is contained in the vent chamber 60. A vent control valve 104 is telescopically supported over the upper end of the stem 102. A synthetic abrasion-resistant cap 106 with attached sleeve 108 covers the control valve 104 and engages the internal cam 70 directly above. A compression spring 110 acts between the cap 106 and the stem bushing 62 to open the vent control valve 104 when the valve assembly 100 is in its fill position (FIG. 4) and close the vent control valve 104 when the valve assembly 100 is in its closed position (FIG. 3). Openings in the sides of the sleeve 108 allow $CO_2$ to vent when the valve assembly 100 is in its fill position.

The lower end of the stem 102 comprises a liquid section which is immersed in the liquid chamber 54. A liquid flow seal 112 is carried on the lower end of the stem 102 for engaging the outlet 52 when the valve assembly 100 is in the closed position, as shown in FIG. 3. When the seal 112 is pressed against the outlet 52, by the action of the internal cam 70, liquid beverage B within the liquid chamber 54 is prevented from escaping. An annular mesh screen 114 is supported on the stem 102 just upstream of the seal 112. An extension tube 115 extends from the lower end of the stem 102 to establish a fill level in the beverage container C. The extension tube 115 may or may not include a float-type valve.

A counterbalance spring 116 is housed within a stationary cage 118 disposed in the liquid chamber 54. The cage 118 includes numerous side openings so that liquid beverage B may freely permeate and fill its interior. A spool 120 within the cage 118 forms a stop for the lower end of the counterbalance spring 116. The upper end of the counterbalance spring 116 bears against a flange 122 which in turn is fixedly connected to the stem 102.

In operation, an empty beverage container C positioned on a platform 20 is lifted into registry with the centering bell 53 of a valve housing 44, thereby establishing a pressure tight seal between the two. As the filling table 16 rotates, the vacuum control valve 94 is first depressed by a stationary cam on the cam rail 76, thus drawing a vacuum on the beverage container C. Then, as the vacuum control valve 94 is returned to a closed condition, the flow control valve 84 is opened by a different stationary cam on the cam rail 76 to fill the beverage container C with $CO_2$ from the interior region 28 of the central tank 26. Another stationary cam actuates the external cam 72 allowing the valve assembly 100 to raise to the fill position (FIG. 4) as soon as the internal pressure in the beverage contain C approaches that in the central tank 26. At this, the flow control valve 84 closes and the counterbalance spring 116 lifts the valve assembly 100 to the fill position, allowing liquid beverage B to flow gently under gravity into the beverage container C.

The (predominantly $CO_2$) gases within the beverage container C are displaced through the extension tube 115 and the stem 102 as liquid beverage B fills the beverage container C. Such displaced gases flow up past the open vent control valve 104 and into the vent chamber 60. From the vent chamber 60, the gases are pushed into the vent passage 86 and then through the vent conduit 40 back to the segregated vent chamber within the central tank 26, as is well known in the art. The liquid beverage B stops flowing into the beverage container C when its level reaches the opening at the lower end of the extension tube 115; at the same time the actuator 64 is rotated to its closed position (FIG. 3) thus depressing the cap 106 and forcing the stem 102 and attached seal 112 downwardly into engagement with the outlet 52. Next, a stationary cam on the cam rail 76 depresses the snift control valve 98, gently depressurizing the liquid and gas contents in the beverage container C and returning it to atmospheric pressure before separation from the centering bell 53. Afterwards, the filled beverage container C together with its platform 20 lowers from the valve housing 44 and is then transferred to a suitable capping/closure operation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A filling apparatus (10) for filling beverage containers (C) with carbonated liquid beverage (B), said apparatus (10) comprising: a base (12) defining a generally vertical axis of rotation (A); a central tank (26) rotatably supported on said base (12) about said axis (A) and having a pressure containing interior region (28); a liquid supply (14) communicating with said central tank (26) for feeding liquid beverage (B) to said interior region (28); a plurality of receiving areas (34) spaced in generally equal radial and equal circumferential increments about said axis (A) and fixedly connected to said central tank (26) for rotation therewith upon said base (12); a liquid conduit (36) extending between said interior region (28) of said central tank (26) and each said receiving area (34); a valve housing (44) supported on each said receiving area (34) and communicating with a corresponding one of said liquid conduits (36), each said valve housing (44) including a liquid chamber (54) having an outlet (52) for discharging liquid into the beverage container (C) and a vent chamber (60) communicating with said pressure contained interior region (28), said vent chamber (60) being totally isolated from said liquid chamber (54); a reciprocating vent stem and valve assembly (100) including a hollow vent stem (102) linearly slidably disposed in each said valve housing (44) and a valve (112) supported on and about said stem (102) for selective movement with said stem (102) between an open position and a closed position sealing said outlet (52) to the beverage container (C) as gases are vented through said hollow vent stem (102) into said vent chamber (60); and a valve actuator (64) extending through said vent chamber (60) of each valve housing (44) and having an internal cam (70) operatively engaging said vent stem (102) for moving said stem (102) and said valve (112) in unison.

2. An assembly as set forth in claim 1 wherein each said valve housing (44) includes a liquid chamber (54) communicating with said outlet (52), and each said vent stem (102) includes a liquid section immersed in said liquid chamber (54).

3. An assembly as set forth in claim 2 wherein each said valve housing (44) includes a vent chamber (60), and each said vent stem (102) includes a vent section disposed in the respective said vent chamber (60).

4. An assembly as set forth in claim 3 further including a gas supply (32) communicating with said central tank (26) for feeding pressurized gas to said interior region (28), and a gas conduit (38) conducting pressurized gas from said interior region (28) of said central tank (26) to each said valve housing (44).

5. An assembly as set forth in claim 4 wherein each said valve housing (44) includes a pressurized gas passage (80) having a discharge (82) downstream of said outlet (52) and a flow control valve (84) upstream of said discharge (82).

6. An assembly as set forth in claim 3 wherein each said stem (102) has a bypass formed therein for venting pressurized gas to said vent chamber (60), said bypass including a vent control valve (104).

7. An assembly as set forth in claim 6 wherein each said valve housing (44) includes a stem bushing (62) slidably supporting said vent stem (102) between said vent chamber (60) and said liquid chamber (54).

8. An assembly as set forth in claim 3 wherein each said valve housing (44) includes a centering bell (53) extending from said outlet (52) for receiving the mouth of a beverage container (C).

9. An assembly as set forth in claim 3 wherein each said valve housing (44) includes a snift aperture (96) downstream of said outlet (52), and a snift control valve (98) operatively associated with said snift aperture (96) for controlling depressurization of a filled beverage container (C).

10. An assembly as set forth in claim 1 wherein each said valve actuator (64) includes a shaft (66) pivotally journaled in said valve housing (44), said shaft (66) supporting said internal cam (70) on one end thereof and an external cam (72) on the other end thereof.

11. A filling apparatus (10) for filling beverage containers (C) with carbonated liquid beverage (B), said apparatus (10) comprising: a base (12) defining a generally vertical axis of rotation (A); a central tank (26) rotatably supported on said base (12) about said axis (A) and having a pressure containing interior region (28); a liquid supply (13) communicating with said central tank (26) for feeding liquid beverage (B) to said interior region (28); a plurality of receiving areas (34) spaced in generally equal radial and equal circumferential increments about said axis (A) and fixedly connected to said central tank (26) for rotation therewith upon said base (12); a liquid conduit (36) extending between said interior region (28) of said central tank (26) and each said receiving area (34); a valve housing (44) supported on each said receiving area (34) and communicating with a corresponding one of said liquid conduits (36), each said valve housing (44) including a liquid chamber (54) having an outlet (52) for discharging liquid into the beverage container (C) and a vent chamber (60) communicating with said pressure contained interior region (28), said vent chamber (60) being totally isolated from said liquid chamber (54); a reciprocating vent stem and valve assembly (100) including a hollow vent stem (102) linearly slidably disposed in each said valve housing (44) and a valve (112) supported on and about said stem (102) for selective movement with said stem (102) between an open position and a closed position sealing said outlet (52) to the beverage container (C) as gases are vented through said hollow vent stem (102) into said vent chamber (60); a vacuum generator; a vacuum conduit (92) extending from said vacuum generator and communicating from each said valve housing (44) for removing gases from a beverage container (C); and a vacuum control valve operatively disposed on the respective said valve housing (44).

* * * * *